US011253089B2

(12) United States Patent
Griggs

(10) Patent No.: US 11,253,089 B2
(45) Date of Patent: Feb. 22, 2022

(54) PILLOW APPARATUS AND SYSTEM

(71) Applicant: The Pillow Club, LLC, Huntington Beach, CA (US)

(72) Inventor: Chris Griggs, Huntington Beach, CA (US)

(73) Assignee: The Pillow Club, LLC, Huntington Beach, CA (US)

( * ) Notice: Subject to any disclaimer, the term of this patent is extended or adjusted under 35 U.S.C. 154(b) by 380 days.

(21) Appl. No.: 16/275,670

(22) Filed: Feb. 14, 2019

(65) Prior Publication Data

US 2019/0254447 A1 Aug. 22, 2019

Related U.S. Application Data

(60) Provisional application No. 62/632,225, filed on Feb. 19, 2018.

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 2009/1018
See application file for complete search history.

(56) References Cited

U.S. PATENT DOCUMENTS 3,148,389 A * 9/1964 Lustig ..... A47G 9/10 5/645
4,930,173 A * 6/1990 Woller ..... A47C 27/144 297/452.48
5,228,158 A * 7/1993 Park ..... A47G 9/10 5/636
6,988,286 B2 * 1/2006 Schecter ..... A47G 9/10 5/645
2005/0210590 A1 * 9/2005 DiGirolamo ..... A47G 9/10 5/636
2006/0272582 A1 * 12/2006 Dunn ..... A01K 1/0353 119/28.5
2007/0245493 A1 * 10/2007 Leifermann ..... A47G 9/10 5/636
2008/0098528 A1 * 5/2008 Delfs ..... A47G 9/10 5/645
2014/0345055 A1 * 11/2014 Li ..... A47G 9/1027 5/630

FOREIGN PATENT DOCUMENTS

GB 2482871 A * 2/2012 ..... A47G 9/10
KR 20100004469 U * 4/2010

* cited by examiner

*Primary Examiner* — Nicholas F Polito

(57) ABSTRACT

A pillow apparatus includes a first cover including a first perimeter. The pillow apparatus also includes a second cover including a second perimeter. At least a portion of the first perimeter is coupled to at least a portion of the second perimeter forming a cavity between the first cover and the second cover. The pillow apparatus further includes a core frame positioned within the cavity. A core frame perimeter of the core frame is coupled to at least one of the first cover or the second cover. In addition, the pillow apparatus includes a core cushion retained by the core frame. The pillow apparatus includes a peripheral cushion retained by the core frame and at least partially surrounding the core cushion. The core cushion has a firmness that is greater than a firmness of the peripheral cushion.

20 Claims, 4 Drawing Sheets

PILLOW APPARATUS AND SYSTEM

CROSS-REFERENCE TO RELATED APPLICATION AND PRIORITY CLAIM

This Application claims priority under 35 U.S.C. § 119(e) to U.S. Provisional Patent Application No. 62/632,225 filed on Feb. 19, 2018. The above-identified provisional patent application is hereby incorporated by reference in its entirety.

TECHNICAL FIELD

The present disclosure relates to a pillow apparatus and cushioning systems.

BACKGROUND

People all over the world use pillows and cushions to support body parts while sedentary. Pillows and cushions are used for a body, a leg, an arm, a back, a head, and the like. However, current pillows and cushions are deficient at providing both support and softness at the same time.

SUMMARY

This disclosure provides an apparatus and systems for providing cushioning support in a pillow or in a cushion, for example.

In a first embodiment, a pillow apparatus is provided. The pillow apparatus includes a first cover including a first perimeter. The pillow apparatus also includes a second cover including a second perimeter. At least a portion of the first perimeter is coupled to at least a portion of the second perimeter forming a cavity between the first cover and the second cover. The pillow apparatus further includes a core frame positioned within the cavity. A core frame perimeter of the core frame is coupled to at least one of the first cover or the second cover. In addition, the pillow apparatus includes a core cushion retained by the core frame. The pillow apparatus includes a peripheral cushion retained by the core frame and at least partially surrounding the core cushion. The core cushion has a firmness that is greater than a firmness of the peripheral cushion.

In a second embodiment, a cushion apparatus is provided. The cushion apparatus includes a first cover including a first perimeter. The cushion apparatus also includes a second cover including a second perimeter. At least a portion of the first perimeter is coupled to at least a portion of the second perimeter forming a cavity between the first cover and the second cover. The cushion apparatus further includes a core frame positioned within the cavity. A core frame perimeter of the core frame is coupled to at least one of the first cover or the second cover. In addition, the cushion apparatus includes a core cushion retained by the core frame. The cushion apparatus includes a peripheral cushion retained by the core frame and at least partially surrounding the core cushion. The core cushion has a density that is greater than a density of the peripheral cushion.

In a third embodiment, a cushion apparatus is provided. The cushion apparatus includes a first cover including a first perimeter. The cushion apparatus also includes a second cover including a second perimeter. At least a portion of the first perimeter is coupled to at least a portion of the second perimeter forming a cavity between the first cover and the second cover. The cushion apparatus further includes a core frame positioned within the cavity. A core frame perimeter of the core frame is coupled to at least one of the first cover or the second cover. In addition, the cushion apparatus includes a core cushion retained by the core frame. The cushion apparatus includes a peripheral cushion retained by the core frame and at least partially surrounding the core cushion. The core cushion has a thickness that is greater than a thickness of the peripheral cushion.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 7, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged wireless communication system.

Figure 1:
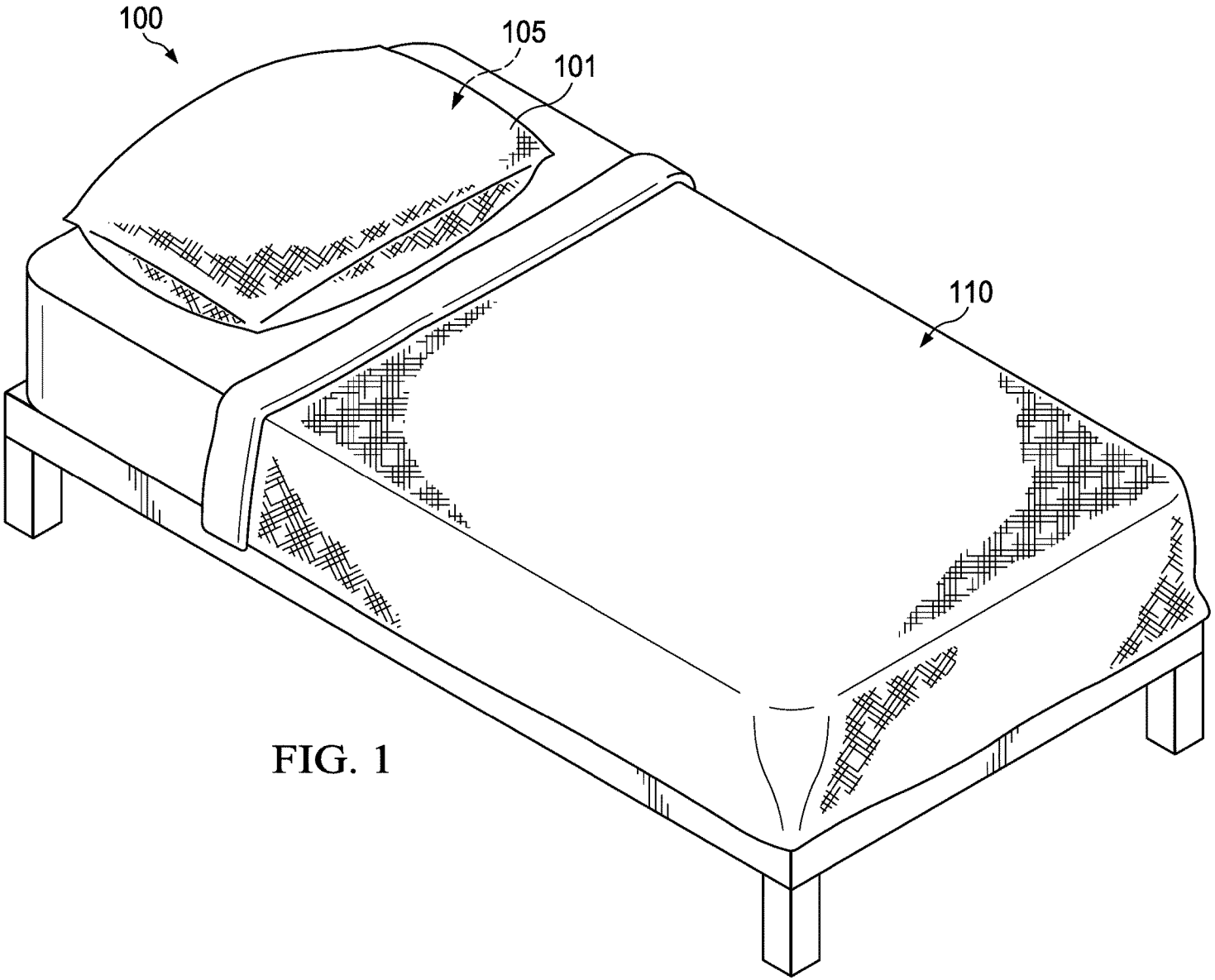
FIG. 1 illustrates a perspective view of a non-limiting, example operating environment for a pillow containing a pillow apparatus according to certain embodiments of this disclosure.

FIG. 1 illustrates a perspective view of a non-limiting, example operating environment 100 for a pillow 101 containing a pillow apparatus 105 according to certain embodiments of this disclosure. As shown in FIG. 1, the operating environment 100 includes a resting structure 110 and a pillow 101 containing a cushion apparatus 105 (e.g., a pillow apparatus) positioned on the resting structure 110. In the example embodiment of FIG. 1, the resting structure 110 is a bed. However, the resting structure 110 may include a plurality of different resting structure types including a chair, a seat, a bench, a table, a sofa, a headrest, an armrest, a foot rest (e.g., an ottoman), a floor, or the like. In certain embodiments, the pillow 101 may be a cushion 101 and the pillow apparatus 105 may be a cushion apparatus 105 contained within the cushion 101. Thus, the cushion 101 containing the cushion apparatus 105 may be a mattress, a mattress cushion (e.g., a mattress pad for placement on top of a mattress), a chair cushion, a seat cushion, a table cushion, a sofa cushion, a headrest cushion, an armrest cushion, a foot rest cushion, a floor cushion, or the like. One having ordinary skill in the art would contemplate the various types of cushions where a cushion apparatus (hereinafter "pillow apparatus") 105 may be utilized.

In certain embodiments, a plurality of pillow apparatuses 105 may be positioned in a pillow or cushion 101. For example, a body pillow designed to support multiple portions of the human body may include two or more pillow apparatuses 105 to provide support and comfort (e.g., varying support and comfort) to two different portions of the human body. The pillow apparatus 105 may include a variety of different shapes and configurations. For example, the pillow apparatus 105 may include rectangular shape to fit with a standard shaped rectangular pillow. As another example, the pillow apparatus 105 may include a circular shape to conform to a circular shape of a circular foot rest. As yet another example, the pillow apparatus 105 may include a long and narrow configuration to conform to a shape of an arm rest cushion. As yet another example, the pillow apparatus 105 may include an unconventional shape or a custom shape to adhere to the contours of an arm, a leg, or a back of a human body. In certain embodiments, the pillow apparatus 105 may be specifically shaped and configured to accommodate one or more specific injuries on a body part of a human body.

Figure 2:
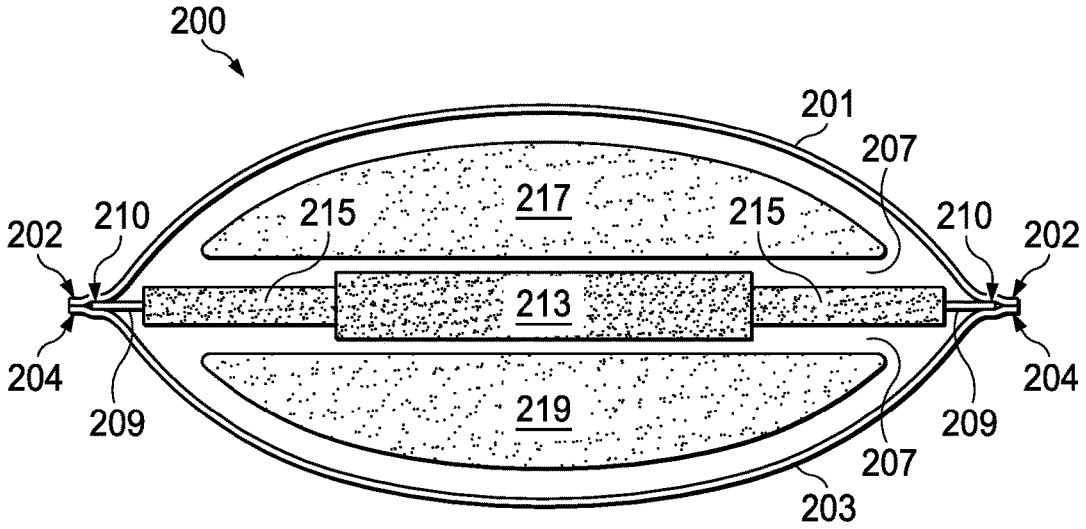
FIG. 2 illustrates a cross-sectional view of a non-limiting, example pillow apparatus according to certain embodiments of this disclosure.

FIG. 2 illustrates a cross-sectional view of a non-limiting, example pillow apparatus 200 according to certain embodiments of this disclosure. The pillow apparatus 200, illustrated in FIG. 2, may be the same as or at least similar to one or more other pillow apparatuses described herein including the pillow apparatus 105 described herein with respect to FIG. 1. The pillow apparatus 200, illustrated in FIG. 2, may include one or more same or at least features as one or more other pillow apparatuses described herein including one or more same or similar features of the pillow apparatus 105 described herein with respect to FIG. 1.

As shown in FIG. 2, the pillow apparatus 200 may include a first cover 201 having a first perimeter 202 and a second cover 203 having a second perimeter 204. The first cover 201 may be coupled to the second cover 203. The pillow apparatus 200 may also include one or more cavities 207 that may be formed between the first cover 201 and the second cover 203. The pillow apparatus 200 may further include a core frame 209 positioned within the one or more cavities 207. The core frame 209 may include a core frame perimeter 210 that is coupled to at least one of the first cover 201 or the second cover 203. In addition, the pillow apparatus 200 may include a core cushion 213 retained by the core frame 209. The pillow apparatus 200 may also include a peripheral cushion 215 retained by the core frame 209 and at least partially surrounding the core cushion 213. As described further herein, at least one of the density, the firmness, or the thickness of the core cushion 213 and the one or more peripheral cushions 215 may enable the pillow apparatus 200 to provide both support and comfort to a user.

In certain embodiments, the pillow apparatus 200 may include an upper cushion 217 positioned in the one or more cavities 207 between the core frame 209 and the first cover 201. In certain embodiments, the pillow apparatus 200 may include a lower cushion 219 positioned in the one or more cavities 207 between the core frame 209 and the second cover 203. It should be understood that for the purposes of this disclosure and unless otherwise specified herein, directional terms including "upper", "top", "above", and the like may refer to a position or location of the pillow apparatus 200 closer to a position or location of the pillow apparatus 200 where a body part (e.g., a head) may make first contact with the pillow apparatus 200 (e.g., engage against the pillow apparatus) relative to one or more other components of the pillow apparatus 200. It should also be understood that for the purposes of this disclosure and unless otherwise specified herein, directional terms including "lower", "bottom", "below", and the like may refer to a position or location of the pillow apparatus 200 further from a position or location of the pillow apparatus 200 where a body part (e.g., a head) may make first contact with the pillow apparatus 200 (e.g., engage against the pillow apparatus) relative to one or more other components of the pillow apparatus 200.

As described herein, the pillow apparatus 200 may include the first cover 201 having the first perimeter 202 and the second cover 203 having the second perimeter 204. Each of the first cover 201 and the second cover 203 may include a conformable material such as a fabric material or the like. In certain embodiments, the first cover 201 may have a size and a shape that are at least similar to a size and a shape of the second cover 203. Thus, when the first cover 201 is positioned over or on the second cover 203, the first perimeter 202 may align with the second perimeter 204. For example, the first cover 201 and the second cover 203 may each have a rectangular shape and a similar size. When the first cover 201 is positioned on or over the second cover 203, all four sides of the first cover 201 forming the first perimeter 202 may align with all four sides of the second cover 203 forming the second perimeter 204. In certain embodiments, each of the first cover 201 and the second cover 203 may be approximately 20 inches wide and 29 inches long. In certain embodiments, the first cover 201 and the second cover 203 may be one cover approximately 40 inches wide and 29 inches long that is folded in half to form the first cover 201 and the second cover 203.

The first cover 201 may be coupled (e.g., fixedly attached, removably attached, indirectly attached, directly attached) to the second cover 203 forming one or more cavities 207 between the first cover 201 and the second cover 203. In certain embodiments, the first cover 201 may be indirectly attached to the second cover 203 using another component (e.g., another piece of conformable material) to bridge a space between the first cover 201 and the second cover 203. In certain embodiments, the first cover 201 may be directly attached to the second cover 203 without using another component in between the first cover 201 and the second cover 203 to bridge a space between the first cover 201 and the second cover 203. In certain embodiments, the first cover 201 may be coupled to the second cover 203 using at least one of stitching, weaving (e.g., a portion of the first cover 201 and a portion of the second cover 203 together), an adhesive (e.g., a glue), a hook and loop fastening system, fasteners (e.g., clamps), or the like.

The first cover 201 may be coupled to the second cover 203 by coupling at least a portion of the first perimeter 202 to at least a portion of the second perimeter 204 forming one or more cavities 207 between the first cover 201 and the second cover 203. In certain embodiments, the first cover 201 may be coupled to the second cover 203 by coupling an entire length of the first perimeter 202 to the second perimeter 204 forming one or more cavities 207 that are completely enclosed by the first cover 201 and the second cover 203. For example, the first cover 201 and the second cover 203 each having a similar circular shape may be coupled to each other by coupling the entire length of the first perimeter 202 to the second perimeter 204 forming one or more cavities 207 that are completely enclosed by the first cover 201 and the second cover 203. A pillow apparatus 200 having one or more cavities 207 that are completely enclosed may prevent one or more components of the pillow apparatus 200 located within the one or more cavities 207 from being separated from the pillow apparatus 200 or from moving out of position relative to one or more other components of the pillow apparatus 200.

In certain embodiments, the first cover 201 may be coupled to the second cover 203 by coupling an initial portion of the first perimeter 202 to an initial portion of the second perimeter 204 while a remaining portion of the first perimeter 202 is not coupled to a remaining portion of the second perimeter 204. For example, a first cover 201 and a second cover 203, each having a rectangular shape and a similar size, may be coupled to each other at three sides of the first perimeter 202 and the second perimeter 204 while a fourth side of the first perimeter 202 is not coupled to a fourth side of the second perimeter 204 forming one or more cavities 207 that are partially enclosed by the first cover 201 and the second cover 203. A pillow apparatus 200 having one or more cavities 207 that are partially enclosed may permit access to repair, adjust, or replace one or more components of the pillow apparatus 200 located within the one or more cavities 207.

The first cover 201 may be removably attached to the second cover 203. In certain embodiments, the first cover 201 is removably attached to the second cover 203 by removably attaching at least a portion of the first perimeter 202 to at least a portion of the second perimeter 204. For example, a first cover 201 and a second cover 203, each having a rectangular shape and a similar size, may be removably attached to each other at three sides of the first perimeter 202 and the second perimeter 204 while a fourth side of the first perimeter 202 is not coupled to a fourth side of the second perimeter 204. As another example, the first cover 201 and the second cover 203, each having a similar circular shape and a similar size, may be removably attached to each other by removably attaching the entire length of the first perimeter 202 to the second perimeter 204. Removably attaching the first cover 201 to the second cover 203 may permit access to repair, adjust, or replace of one or more components of the pillow apparatus 200 located within the one or more cavities 207. Additionally, or alternatively, removably attaching the first cover 201 to the second cover 203 may permit replacement of the first cover 201 or the second cover 203. It should be understood that when a first component (e.g., a first cover 201) is removably attached to a second component (e.g., a second cover 203), repeatedly, the first component may be attached to the second component, subsequently detached from the second component, and again attached to the second component without damaging (e.g., physically, structurally) the first component, the second component, or one or more other components of the pillow apparatus 200.

In certain embodiments, the first cover 201 is fixedly attached to the second cover 203 by fixedly attaching at least a portion of the first perimeter 202 to at least a portion of the second perimeter 204. For example, the first cover 201 and the second cover 203, each having a rectangular shape and a similar size, may be fixedly attached to each other at three sides of the first perimeter 202 and the second perimeter 204 while a fourth side of the first perimeter 202 is either removably attached or not coupled to a fourth side of the second perimeter 204. As another example, the first cover 201 and the second cover 203, each having a similar circular shape and a similar size, may be fixedly attached to each other by fixedly attaching the entire length of the first perimeter 202 to the second perimeter 204. It should be understood that when a first component (e.g., a first cover 201) is fixedly attached to a second component (e.g., a second cover 203), the first component may not be detached from the second component without damaging the first component, the second component, or one or more other components of the pillow apparatus 200.

As described herein, the pillow apparatus 200 may include a core frame 209 positioned within the one or more cavities 207. The core frame 209 may include a conformable material such as a fabric material or the like. In certain embodiments, the core frame 209 may also include at least one dimension that has a length that is no less than a width or a length of at least one of the first cover 201 or the second cover 203. For example, when the first cover 201 and the second cover 203 each have a rectangular shape with a similar size and similar dimensions, the core frame 209 may also have a length that is no less than a width or length of the first cover 201 and the second cover 203. In certain embodiments, the core frame 209 may include a size and a shape that is at least similar to a size and a shape of at least one of the first cover 201 or the second cover 203. For example, when the first cover 201 and the second cover 203 each have a circular shape with a similar size, the core frame 209 may also have a circular shape with the similar size. These configurations may allow the core frame 209 to extend through the one or more cavities 207, extend across a substantial portion of the pillow apparatus 200, and maintain a relatively static position with respect to one or more other components of the pillow apparatus 200.

The core frame 209 may include a core frame perimeter 210 that is coupled to at least one of the first cover 201 or the second cover 203. For example, the core frame 209 may extend through the one or more cavities 207 and across a substantial portion of the pillow apparatus 200 so that the core frame perimeter 210 couples to at least one of the first cover 201 or the second cover 203. In certain embodiments, the core frame perimeter 210 may couple the core frame 209 to either the first cover 201 or the second cover 203. For example, the core frame perimeter 210 may couple the core frame 209 to either the first cover 201 or the second cover 203 at one or more locations where the first perimeter 202 does not couple with the second perimeter 204. In certain embodiments, the core frame perimeter 210 may couple the core frame 209 to both the first cover 201 and the second cover 203. For example, the core frame perimeter 210 may couple to both the first cover 201 and the second cover 203 at one or more locations where the first perimeter 202 and the second perimeter 204 are coupled.

As shown in FIG. 2, the core frame perimeter 210 may extend between the first perimeter 202 and the second perimeter 204 (e.g., in a stacked configuration) coupling to both the first perimeter 202 and the second perimeter 204 to couple the core frame 209 to the first cover 201 and the second cover 203. In some embodiments, with the core frame perimeter 210 positioned between the first perimeter 202 and the second perimeter 204, the first perimeter 202 may be indirectly coupled to the second perimeter 204 via the core frame perimeter 210. In some embodiments, the core frame perimeter 210 may be positioned between only a portion of the first perimeter 202 and the second perimeter 204 allowing the first perimeter 202 and the second perimeter 204 to be directly coupled to each other. These configurations may allow the core frame 209 to be retained in a relatively static position within the one or more cavities 207 and with respect to one or more other components (e.g., the first cover 201 and the second cover 203) of the pillow apparatus 200.

It should be understood that for the core frame 209 to maintain a relatively static position within the one or more cavities 207 and with respect to one or more other components of the pillow apparatus 200, the core frame perimeter 210 should couple to at least two different locations of at least one of the first cover 201 (e.g., an inner surface of the first cover 201, the first perimeter 202) or the second cover 203 (e.g., an inner surface of the second cover 203, the second perimeter 204). For example, when the first cover 201, the second cover 203, and the core frame 209 have one or more flat edges (e.g., when the first cover 201, the second cover 203, and the core frame 209 have a triangular shape, a rectangular shape, a pentagonal shape, a hexagonal shape, a trapezoidal shape, an octagonal shape, or the like), at least two sides that are substantially (e.g., approximately, relatively) opposing sides of the core frame 209 may couple to at least two locations on at least one of the first cover 201 or the second cover 203 that are substantially opposing each other. As another example, when the first cover 201, the second cover 203, and the core frame 209 have one or more flat edges (e.g., when the first cover 201, the second cover 203, and the core frame 209 have a triangular shape, a rectangular shape, a pentagonal shape, a hexagonal shape, a trapezoidal shape, an octagonal shape, or the like), at least three sides of the core frame 209 that are substantially equidistant from each other may couple to at least three locations on at least one of the first cover 201 or the second cover 203 that are substantially equidistant from each other.

As yet another example, when the first cover 201, the second cover 203, and the core frame 209 have one or more edges (e.g., when the first cover 201, the second cover 203, and the core frame 209 have a circular shape, an oval shape, both flat and curved edges, a triangular shape, a rectangular shape, a pentagonal shape, a hexagonal shape, a trapezoidal shape, an octagonal shape, or the like), at least three points that are not all immediate adjacent to each other along the core frame perimeter 210 of the core frame 209 may couple to at least three locations on at least one of the first cover 201 or the second cover 203 that are not all immediately adjacent to each other. As yet another example, when the first cover 201, the second cover 203, and the core frame 209 have one or more edges (e.g., when the first cover 201, the second cover 203, and the core frame 209 have a circular shape, an oval shape, both flat and curved edges, a triangular shape, a rectangular shape, a pentagonal shape, a hexagonal shape, a trapezoidal shape, an octagonal shape, or the like), all edges of the core frame perimeter 210 of the core frame 209 may couple to at least one of the first cover 201 or the second cover 203.

Figure 3:
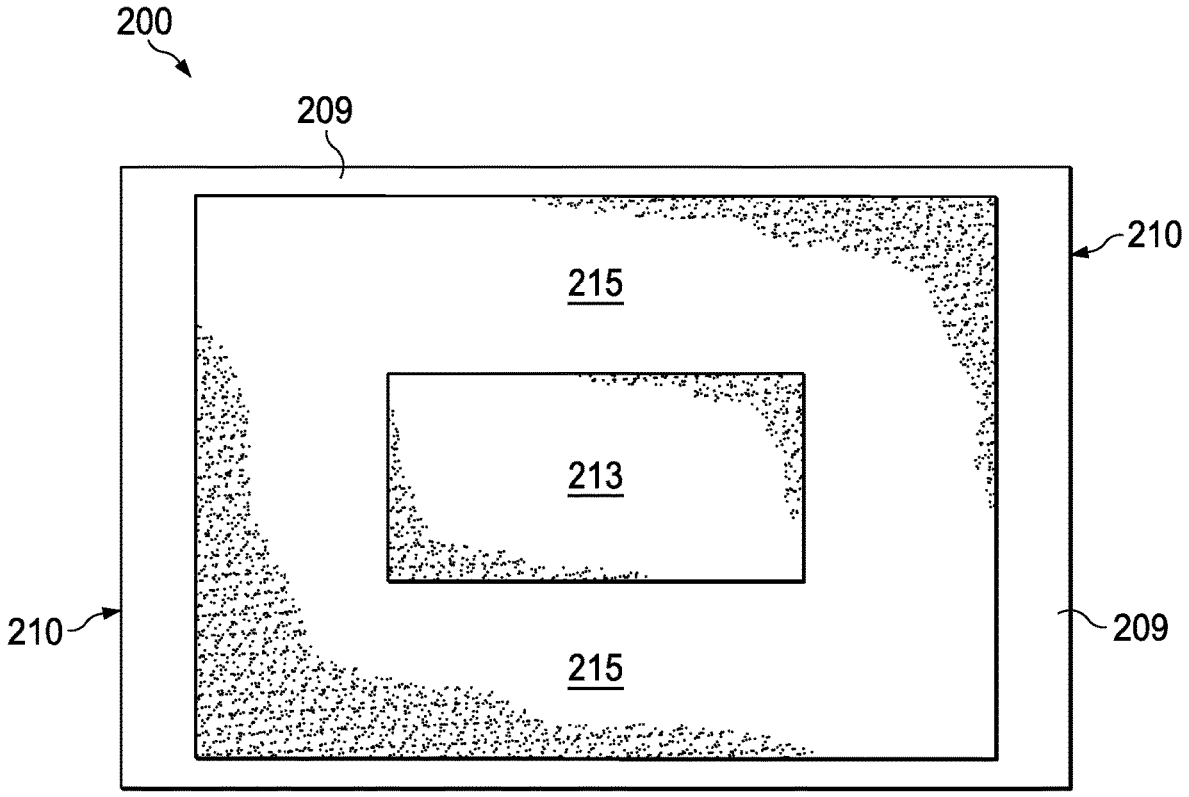
FIG. 3 illustrates a perspective view of a non-limiting, example core frame, core cushion, and peripheral cushion of a pillow apparatus according to certain embodiments of this disclosure.

As described herein, the pillow apparatus 200 may include a core cushion 213 and one or more peripheral cushions 215 retained in the one or more cavities 207 by the core frame 209. FIG. 3 illustrates a perspective view of a non-limiting, example core frame 209, core cushion 213, and peripheral cushion 215 of a pillow apparatus 200 according to certain embodiments of this disclosure. Generally, the core cushion 213 and the one or more peripheral cushions 215 may be retained in the one or more cavities 207 by the core frame 209 so that the core cushion 213 and the one or more peripheral cushions 215 form a cushion layer (e.g., are positioned laterally relative to each other, are not stacked on top of each other) of the pillow apparatus 200 between a top portion (e.g., the first cover 201) of the pillow apparatus 200 and a bottom portion (e.g., the second cover 203) of the pillow apparatus 200. In certain embodiments, the core frame 209 may retain one core cushion 213 and one or more peripheral cushions 215 on a single side of the core frame 209 (e.g., a top side, a bottom side). In certain embodiments, the core frame 209 may retain one core cushion 213 and one or more peripheral cushions 215 on both a top side of the core frame 209 and a bottom side of the core frame 209. In certain embodiments, the core frame 209 may retain one core cushion 213 and one or more peripheral cushions 215 that are bisected by a plane occupied by the core frame 209.

In certain embodiments, the core cushion 213 and the one or more peripheral cushions 215 may form a cushion layer of the pillow apparatus 200 between a top portion (e.g., the first cover 201) of the pillow apparatus 200 and a bottom portion (e.g., the second cover 203) of the pillow apparatus 200 that extends to a size and a shape of at least one of the first cover 201, the second cover 203, or the core frame 209. For example, when the first cover 201, the second cover 203, and the core frame 209 have a rectangular shape and a similar size, the combination of the core cushion 213 and the one or more peripheral cushions 215 may form a cushion layer that has the same rectangular shape (as shown in FIG. 3) and a same size as the first cover 201, the second cover 203, and the core frame 209. In certain embodiments, the core cushion 213 and the one or more peripheral cushions 215 may form a cushion layer of the pillow apparatus 200 between a top portion (e.g., the first cover 201) of the pillow apparatus 200 and a bottom portion (e.g., the second cover 203) of the pillow apparatus 200 that extends to a size and a shape that is at least one of a different shape or a lesser size than at least one of the first cover 201, the second cover 203, or the core frame 209. For example, when the first cover 201, the second cover 203, and the core frame 209 have a circular shape and a similar size, the combination of the core cushion 213 and the one or more peripheral cushions 215 may form a cushion layer that has at least one of continuous cushion (e.g., no spaces on the core frame 209 without either a core cushion 213 or a peripheral cushion 215, no spaces on the core frame 209 without any cushioning) (as shown in FIG. 3), an octagonal shape, or a size that is a fraction of the size of the first cover 201, the second cover 203, and the core frame 209. As another example, when the first cover 201, the second cover 203, and the core frame 209 have a rectangular shape and a similar size, the combination of the core cushion 213 and the one or more peripheral cushions 215 may form a cushion layer that has at least one of discontinuous cushion (e.g., one or more spaces on the core frame 209 without either a core cushion 213 or a peripheral cushion 215, one or more spaces on the core frame 209 without any cushioning), an octagonal shape, or a size that is a fraction of the size of the first cover 201, the second cover 203, and the core frame 209.

The core cushion 213 may be retained by the core frame 209 in a central position (e.g., a middle position) of the pillow apparatus 200. For example, when the first cover 201 and the second cover 203 have a circular shape, the core frame 209 may retain the core cushion 213 in the one or more cavities 207 at a position that aligns the center of the circular first cover 201 and the center of the circular second cover 203 with a center of the core cushion 213. As another example, when the first cover 201 and the second cover 203 have a rectangular shape, the core frame 209 may retain the core cushion 213 in the one or more cavities 207 at a position where a center of the core cushion 213 is equidistant from at least two sides of the first perimeter 202 or the second perimeter 204. In certain embodiments, the core cushion 213 may be retained by the core frame 209 in a specified position of the pillow apparatus. For example, the core frame 209 may retain the core cushion 213 in the one or more cavities 207 in a position to provide support to a specific body part, such as a head, a neck, a leg, a back, an arm, a combination thereof, or the like. As another example, the core frame 209 may retain two or more core cushions 213 in the one or more cavities 207 in two or more positions to provide support to one or more specific body parts, such as a head, a neck, a leg, a back, an arm, a combination thereof, or the like. As yet another example, the core frame 209 may retain one or more core cushions 213 in the one or more cavities 207 in one or more positions to provide support to one or more specific body parts relative to one or more other specific body parts.

Figure 4:
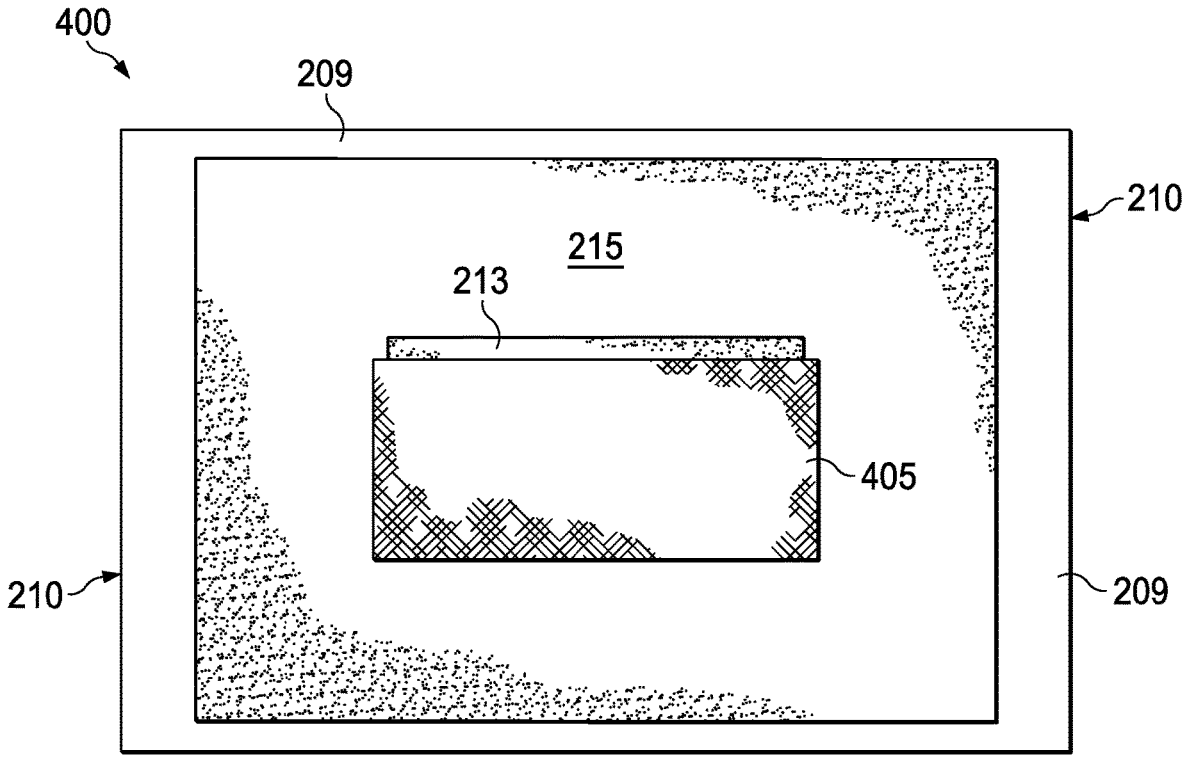
FIG. 4 illustrates a perspective view of a non-limiting, example core frame, core cushion, peripheral cushion, and pocket of a pillow apparatus according to certain embodiments of this disclosure.

In certain embodiments, the core cushion 213 may be retained by the core frame 209 using one or more of stitching, an adhesive, a pocket, or the like. FIG. 4 illustrates a perspective view of a non-limiting, example core frame 209, core cushion 213, peripheral cushion 215, and a pocket 405 of a pillow apparatus 400 according to certain embodiments of this disclosure. The pillow apparatus 400 may include one or more same or similar features, elements, or components of any other pillow apparatus or pillow system described herein including pillow apparatus 200. As shown in FIG. 4, the core frame 209 may include a pocket 405. The pocket 405 may receive the core cushion 213 so that the core frame 209 retains the core cushion 213 in a particular position of the pillow apparatus 400. The pocket 405 may include an opening to receive the core cushion 213 which may remain open or include a closing mechanism (e.g., a zipper, a hook and loop fastening system, one or more button and button holes, or the like). Additionally, or alternatively, and at least similar to the core cushion 213, the one or more peripheral cushions 215 may be retained by the core frame 209 using one or more of stitching, an adhesive, a pocket, or the like.

The one or more peripheral cushions 215 may be retained by the core frame 209 so that the one or more peripheral cushions 215 at least partially surround the core cushion 213. For example, when the core cushion 213 is positioned at a center of the pillow apparatus 200, the one or more peripheral cushions 215 may be retained by the core frame 209 in one or more positions at least partially surrounding the core cushion 213 and that are not located at a central position of the pillow apparatus 200. As another example, when the pillow apparatus 200 includes one or more core cushions 213 that are not located a center position, the one or more peripheral cushions 215 may be retained by the core frame 209 in one or more positions at least partially surrounding the core cushion 213 which may include a center position. As yet another example, one or more peripheral cushions 215 may at least partially surround the core cushion 213 without extending directly above or directly below the core cushion 213. As yet another example and as described further herein, one or more peripheral cushions 215 may at least partially surround the core cushion 213 and extend into a location that is directly above or directly below the core cushion 213.

In certain embodiments, the one or more peripheral cushions 215 may be retained by the core frame 209 so that the one or more peripheral cushions 215 surround and abut an entire lateral perimeter of the core cushion 213 (e.g., so that no lateral surface of the core cushion 213 abuts an open space where no cushion exists). For example, a peripheral cushion 215 may include a circular section cut-out portion with a core cushion 213 placed in and filling the entire circular section cut-out portion so that the peripheral cushion 215 laterally surrounds the core cushions 213 and abuts an entire lateral perimeter of the core cushion 213. In certain embodiments, the one or more peripheral cushions 215 may be retained by the core frame 209 so that the one or more peripheral cushions 215 surround and abut less than an entire lateral perimeter of the core cushion 213 (e.g., so that at least a portion of the lateral surface of the core cushion 213 abuts an open space where no cushion exists). For example, a peripheral cushion 215 may include a circular section cut-out portion with a square shaped core cushion 213 placed in the circular section cut-out portion so that the peripheral cushion 215 laterally surrounds the core cushions 213 and abuts only some of the lateral perimeter of the core cushion 213. FIGS. 2, 3, and 4 illustrate examples of one or more peripheral cushions 215 at least partially surrounding the core cushion 213.

The core cushion 213 and the one or more peripheral cushions 215 may each include one or more characteristics that provide both support and comfort to a user. These characteristics may include a difference in material, a difference in material type (e.g., the core cushion 213 may include a first type of foam and the one or more peripheral cushions 215 may include a second type of foam that is different from the first type of foam), a difference in material firmness, a difference in material thickness, a difference in material density, a combination thereof, or the like. Generally, the combination of the core cushions 213 and the one or more peripheral cushions 215 provide the pillow apparatus 200 with comfort and support. For example, a core cushion 213 having a material with at least one of a greater thickness, a greater firmness, or a greater density than a material of the one or more peripheral cushions 215 may provide the pillow apparatus 200 with a sufficient amount of support for a user (e.g., the core cushion 213 of the pillow apparatus 200 may deflect or compress less than the one or more peripheral cushions 215 when a force is applied against the core cushion 213) while the one or more peripheral cushions having a material with at least one of a lesser thickness, a lesser firmness, or a lesser density than a material of the core cushion 213 may also provide the pillow apparatus 200 with a sufficient amount of comfort for the user (e.g., the one or more peripheral cushions 215 of the pillow apparatus 200 may deflect or compress more than the core cushion 213 when a force is applied against the one or more peripheral cushions 215). As another example, the core cushion 213 may provide the pillow apparatus 200 with an amount of support (e.g., and a lesser amount of comfort) and the one or more peripheral cushions 215 may provide the pillow apparatus 200 with an amount of comfort (e.g., and a lesser amount of support) so that the combination of the core cushion 213 and the one or more peripheral cushions 215 provide the pillow apparatus 200 with both a sufficient amount of support and a sufficient amount of comfort for a user. A material of the core cushion 213 may include at least one of a memory foam material, a latex material, a gel material, a fibrous material, a porous material, or the like. A material of the one or more peripheral cushions 215 may include at least one of a memory foam material, a latex material, a gel material, a fibrous material, a porous material, or the like. In certain embodiments, the core cushion 213 may include one or more materials that are different from one or more materials of the peripheral cushion 215. Additionally, or alternatively, the core cushion 213 may include one or more materials that are the same as one or more materials of the peripheral cushion 215.

In certain embodiments, the core cushion 213 may have a thickness (e.g., from a top direction towards a bottom direction, from a bottom direction towards a top direction) that is greater than a thickness of the one or more peripheral cushions 215. For example, the core cushion 213 and the one or more peripheral cushions 215 may include a same material while the thickness of the core cushion 213 is greater than the thickness of the one or more peripheral cushions 215. As another example, the core cushion 213 and the one or more peripheral cushions 214 may include different materials while the thickness of the core cushion 213 is greater than the thickness of the one or more peripheral cushions 215. As yet another example, the core cushion 213 may have a density that is no less than (e.g., greater than, equal to) than a density of the one or more peripheral cushions 215 while the thickness of the core cushion 213 has a greater thickness than the thickness of the one or more peripheral cushions 215. As yet another example, the core cushion 213 may have a firmness that is no less than a firmness of the one or more peripheral cushions 215 while the thickness of the core cushion 213 has a greater thickness than the thickness of the one or more peripheral cushions 215. As yet another example, the core cushion 213 may have a firmness that is no less than a firmness of the one or more peripheral cushions 215 and a density that is no less than a density of the one or more peripheral cushions 215 while the thickness of the core cushion 213 has a greater thickness than the thickness of the one or more peripheral cushions 215.

In certain embodiments, the thickness of the core cushion 213 is greater than a thickness of the one or more peripheral cushions 215 and the thickness of the one or more peripheral cushions 215 decreases from a position closest to the core cushion 213 to a position furthest away from the core cushion 213. For example, the core cushion 213 may be a center cushion of the pillow apparatus 200 and the one or more peripheral cushions 215 may include a plurality of ring-shaped cushions surrounding the core cushion 213. The plurality of ring-shaped cushions may include a first ring-shaped cushion that has a first radius for surrounding the core cushion 213. The first ring-shaped cushion may have a first thickness that is less than the thickness of the core cushion 213. The plurality of ring-shaped cushions may also include a second ring-shaped cushion that has a second radius for surrounding the core cushion 213 and the first ring-shaped cushion. The second ring-shaped cushion may have a second thickness that is less than the thickness of the core cushion 213 and less than the first thickness of the first ring-shaped cushion. The plurality of ring-shaped cushions may also include a third ring-shaped cushion that has a third radius for surrounding the core cushion 213, the first ring-shaped cushion, and the second ring-shaped cushion. The third ring-shaped cushion may have a third thickness that is less than the thickness of the core cushion 213, less than the first thickness of the first ring-shaped cushion, and less than the second thickness of the second ring-shaped cushion.

In certain embodiments, the core cushion 213 may have a firmness that is greater than a firmness of the one or more peripheral cushions 215. For example, the core cushion 213 and the one or more peripheral cushions 215 may include a same material while the firmness of the core cushion 213 is greater than the firmness of the one or more peripheral cushions 215. As another example, the core cushion 213 and the one or more peripheral cushions 214 may include different materials while the firmness of the core cushion 213 is greater than the firmness of the one or more peripheral cushions 215. As yet another example, the core cushion 213 may have a density that is no less than (e.g., greater than, equal to) a density of the one or more peripheral cushions 215 while the firmness of the core cushion 213 is greater than the firmness of the one or more peripheral cushions 215. As yet another example, the core cushion 213 may have a thickness that is no less than a thickness of the one or more peripheral cushions 215 while the firmness of the core cushion 213 is greater than the firmness of the one or more peripheral cushions 215. As yet another example, the core cushion 213 may have a thickness that is no less than a thickness of the one or more peripheral cushions 215 and a density that is no less than a density of the one or more peripheral cushions 215 while the firmness of the core cushion 213 is greater than the firmness of the one or more peripheral cushions 215.

In certain embodiments, the firmness of the core cushion 213 is greater than a firmness of the one or more peripheral cushions 215 and the firmness of the one or more peripheral cushions 215 decreases from a position closest to the core cushion 213 to a position furthest away from the core cushion 213. For example, the core cushion 213 may be a center cushion of the pillow apparatus 200 and the one or more peripheral cushions 215 may include a plurality of ring-shaped cushions surrounding the core cushion 213. The plurality of ring-shaped cushions may include a first ring-shaped cushion that has a first radius for surrounding the core cushion 213. The first ring-shaped cushion may have a first firmness that is less than the firmness of the core cushion 213. The plurality of ring-shaped cushions may also include a second ring-shaped cushion that has a second radius for surrounding the core cushion 213 and the first ring-shaped cushion. The second ring-shaped cushion may have a second firmness that is less than the firmness of the core cushion 213 and less than the first firmness of the first ring-shaped cushion. The plurality of ring-shaped cushions may also include a third ring-shaped cushion that has a third radius for surrounding the core cushion 213, the first ring-shaped cushion, and the second ring-shaped cushion. The third ring-shaped cushion may have a third firmness that is less than the firmness of the core cushion 213, less than the first firmness of the first ring-shaped cushion, and less than the second firmness of the second ring-shaped cushion.

In certain embodiments, the core cushion 213 may have a material with a density that is greater than a density of a material of the one or more peripheral cushions 215. For example, the core cushion 213 and the one or more peripheral cushions 214 may include a same material while the density of the material of the core cushion 213 is greater than a density of the material of the one or more peripheral cushions 215. As another example, the core cushion 213 and the one or more peripheral cushions 214 may include different materials while a density of a material of the core cushion 213 is greater than a density of a material of the one or more peripheral cushions 215. As yet another example, the core cushion 213 may have a firmness that is no less than (e.g., greater than, equal to) a firmness of the one or more peripheral cushions 215 while a density of a material of the core cushion 213 is greater than a density of a material of the one or more peripheral cushions 215. As yet another example, the core cushion 213 may have a thickness that is no less than a thickness of the one or more peripheral cushions 215 while the density of a material of the core cushion 213 is greater than the density of a material of the one or more peripheral cushions 215. As yet another example, the core cushion 213 may have a firmness that is no less than a firmness of the one or more peripheral cushions 215 and a thickness that is no less than a thickness of the one or more peripheral cushions 215 while the density of a material of the core cushion 213 is greater than the density of a material of the one or more peripheral cushions 215.

In certain embodiments, the density of a material of the core cushion 213 is greater than a density of a material of the one or more peripheral cushions 215 and the density of a material of the one or more peripheral cushions 215 decreases from a position closest to the core cushion 213 to a position furthest away from the core cushion 213. For example, the core cushion 213 may be a center cushion of the pillow apparatus 200 and the one or more peripheral cushions 215 may include a plurality of ring-shaped cushions surrounding the core cushion 213. The plurality of ring-shaped cushions may include a first ring-shaped cushion that has a first radius for surrounding the core cushion 213. The first ring-shaped cushion may have a first density that is less than the density of the core cushion 213. The plurality of ring-shaped cushions may also include a second ring-shaped cushion that has a second radius for surrounding the core cushion 213 and the first ring-shaped cushion. The second ring-shaped cushion may have a second density that is less than the density of the core cushion 213 and less than the first density of the first ring-shaped cushion. The plurality of ring-shaped cushions may also include a third ring-shaped cushion that has a third radius for surrounding the core cushion 213, the first ring-shaped cushion, and the second ring-shaped cushion. The third ring-shaped cushion may have a third density that is less than the density of the core cushion 213, less than the first density of the first ring-shaped cushion, and less than the second density of the second ring-shaped cushion.

In certain embodiments, the pillow apparatus may include at least one of an upper cushion 217 or a lower cushion 219. As shown in FIG. 2, the upper cushion 217 may be positioned within the one or more cavities 207 between the first cover 201 and the core frame 209. The lower cushion 219 may be positioned within the one or more cavities 207 and between the second cover 203 and the core frame 209. The upper cushion 217 and the lower cushion 219 are each configured to provide comfort and some support to the pillow apparatus 200. In certain embodiments and as described herein, the one or more peripheral cushions 215 may surround the core cushion 213 and extend to a location that is above or below the core cushion 213. In this example, the one or more peripheral cushions 215 may also form the upper cushion 217 and the lower cushion 219. In other embodiments, the upper cushion 217 and the lower cushion 219 are separate and distinct components of the pillow apparatus 200 and thus are not either the core cushion 213 or the one or more peripheral cushions 215.

In certain embodiments, the upper cushion 217 or the lower cushion 219 may include two or more separate pieces of material (e.g., two or more pieces of foam). For example, the upper cushion 217 or the lower cushion 219 may include two or more strips of material, cubes of material, orbs of material, lengths of material, or the like. As another example, the upper cushion 217 or the lower cushion 219 may include shredded material (e.g., shredded foam, finely shredded foam), grounded-up material, confetti-like material, or the like. In certain embodiments, the upper cushion 217 may include one or more materials that are different from one or more materials of at least one of the core cushion 213, the peripheral cushion 215, or the lower cushion 219. For example, the upper cushion 217 may include a first type of foam and the lower cushion 219 may include a second type of foam that is different from the first type of foam. Additionally, or alternatively, the upper cushion 217 may include one or more materials that are the same as one or more materials of at least one of the core cushion 213, the peripheral cushion 215, or the lower cushion 219. For example, the upper cushion 217 and the lower cushion 219 may include a same type of foam. In certain embodiments, the lower cushion 219 may include one or more materials that are different from one or more materials of at least one of the core cushion 213, the peripheral cushion 215, or the upper cushion 217. For example, the lower cushion 219 may include a first type of foam and the peripheral cushion 215 may include a second type of foam that is different from the first type of foam. Additionally, or alternatively, the lower cushion 219 may include one or more materials that are the same as one or more materials of at least one of the core cushion 213, the peripheral cushion 215, or the upper cushion 217. For example, the lower cushion 219 and the peripheral cushion 215 may include a same type of foam. In certain embodiments, at least one of the upper cushion 217 or the lower cushion 219 may include one or more materials that are different from one or more materials of at least one of the core cushion 213 or the peripheral cushion 215. For example, the lower cushion 219 may include a first type of foam and the core cushion 213 may include a second type of foam that is different from the first type of foam. Additionally, or alternatively, at least one of the upper cushion 217 or the lower cushion 219 may include one or more materials that are the same as one or more materials of at least one of the core cushion 213 or the peripheral cushion 215. For example, the upper cushion 217, the lower cushion 219, and the peripheral cushion 215 may include a same type of foam.

In certain embodiments, the pillow apparatus 200 may not include the peripheral cushion 215 and thus, the core frame 209 may only retain the core cushion 213. In this case, the core frame 209 may act as the peripheral cushion 215 and include one or more relative characteristics (e.g., thickness, density, firmness) with respect to the core cushion 213 described herein. Additionally, or alternatively, when the pillow apparatus 200 includes the upper cushion 217 or the lower cushion 219, the upper cushion 217 or the lower cushion 219 may act as the peripheral cushion 215 (e.g., without being retained by the core frame 209, by at least partially surrounding the core cushion 213) and include one or more relative characteristics (e.g., thickness, density, firmness) with respect to the core cushion 213 described herein.

Figure 5:
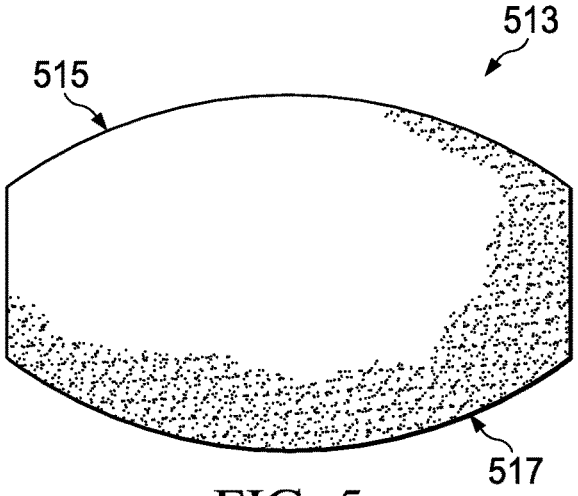
FIG. 5 illustrates a perspective view of a non-limiting, example core cushion of a pillow apparatus according to certain embodiments of this disclosure.

As described herein, the core cushion 213 may provide the pillow apparatus 200 with an amount of support (e.g., and a lesser amount of comfort). FIG. 5 illustrates a perspective view of a non-limiting, example core cushion 513 of a pillow apparatus 200 (or a pillow apparatus 400) according to certain embodiments of this disclosure. In certain embodiments, the core cushion 513 may include varying thickness (e.g., from a top direction towards a bottom direction, from a bottom direction towards a top direction). For example, as shown in FIG. 5, an upper surface 515 of the core cushion 513 may have a dome-like configuration giving the center of the core cushion 513 a greatest thickness of the core cushion 513 and giving the core cushion 513 a gradual decrease in thickness from a center of the core cushion 513 to a periphery of the core cushion 513. Similarly, as shown in FIG. 5, a lower surface 517 of the core cushion 513 may have a dome-like configuration giving the center of the core cushion 513 a greatest thickness of the core cushion 513 and giving the core cushion 513 a gradual decrease in thickness from the center of the core cushion 513 to a periphery of the core cushion 513.

Figure 6:
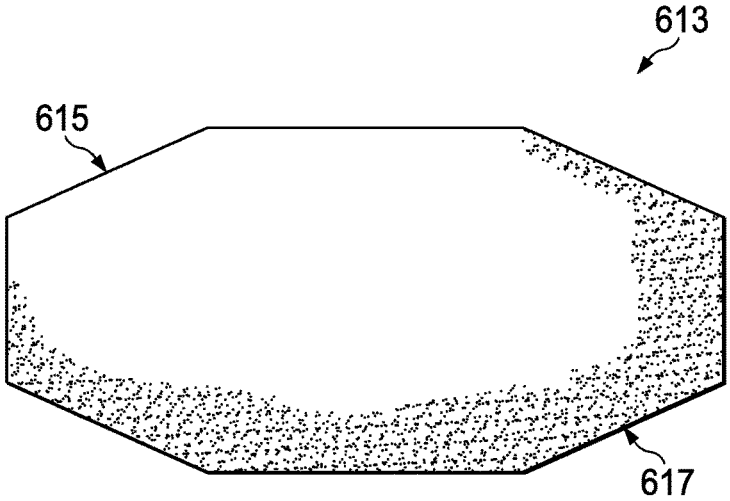
FIG. 6 illustrates a perspective view of another non-limiting, example core cushion of a pillow apparatus according to certain embodiments of this disclosure.

As described herein, the core cushion 213 may provide the pillow apparatus 200 with an amount of support (e.g., and a lesser amount of comfort). FIG. 6 illustrates a perspective view of another non-limiting, example core cushion 613 of a pillow apparatus 200 (or a pillow apparatus 400) according to certain embodiments of this disclosure. In certain embodiments, the core cushion 613 may include varying thickness (e.g., from a top direction towards a bottom direction, from a bottom direction towards a top direction). For example, as shown in FIG. 6, an upper surface 615 of the core cushion 613 may have a flat configuration giving the center of the core cushion 613 a greatest thickness of the core cushion 613. The upper surface 615 of the core cushion 613 may also include beveled edges around the periphery of the core cushion 613 giving the core cushion 613 a decrease in thickness from the center of the core cushion 613 to the periphery of the core cushion 613. Similarly, as shown in FIG. 6, a lower surface 617 of the core cushion 613 may have a flat configuration giving the center of the core cushion 613 a greatest thickness of the core cushion 613. The lower surface 617 of the core cushion 613 may also include beveled edges around the periphery of the core cushion 613 giving the core cushion 613 a decrease in thickness from the center of the core cushion 613 to the periphery of the core cushion 613.

Figure 7:
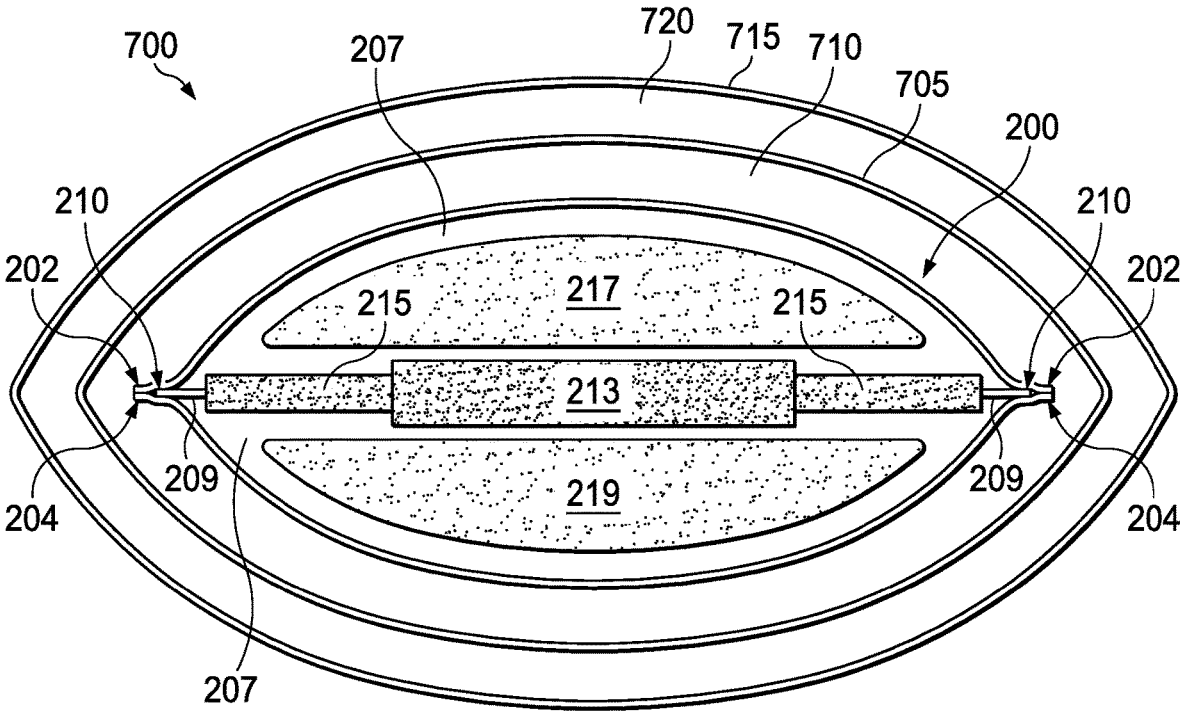
FIG. 7 illustrates a cross-sectional view of a non-limiting, example pillow system according to certain embodiments of this disclosure.

FIG. 7 illustrates a cross-sectional view of a non-limiting, example pillow system 700 according to certain embodiments of this disclosure. The pillow system 700 may include one or more same or similar features, components, or elements of the pillow apparatus 200 or the pillow apparatus 400 described herein. The pillow system 700 may also include a pillow apparatus enclosure 705. The pillow apparatus enclosure 705 may form a cavity 710 for retaining the pillow apparatus 200 (or the pillow apparatus 400). The pillow apparatus enclosure 705 may include a fabric material and may completely enclose the pillow apparatus 200 (or the pillow apparatus 400) in the cavity 710. The pillow system 700 may also include a pillow case 715. The pillow case 715 may form a cavity 720 for retaining the pillow apparatus enclosure 705 containing the pillow apparatus 200 (or the pillow apparatus 400). The pillow apparatus enclosure 705 may include a fabric material and may include an opening to receive and retain the pillow apparatus enclosure 705 containing the pillow apparatus 200 (or the pillow apparatus 400).

What is claimed is:

1. A pillow apparatus comprising:

a first cover including a first perimeter;

a second cover including a second perimeter, wherein at least a portion of the first perimeter is coupled to at least a portion of the second perimeter forming a cavity between the first cover and the second cover; and a core frame positioned within the cavity, wherein the core frame is planar, and wherein the core frame includes:

a core cushion retained in a center portion of the core frame; and a peripheral cushion retained within the core frame and surrounding and abutting an entire lateral perimeter of the core cushion, wherein the core cushion has a firmness that is greater than a firmness of the peripheral cushion, wherein a core frame perimeter of the core frame is coupled to at least one of the first cover or the second cover at one or more locations where the at least a portion of the first perimeter is coupled to the at least a portion of the second perimeter.

2. The pillow apparatus of claim 1, further comprising an upper cushion positioned in the cavity between the core frame and the first cover.

3. The pillow apparatus of claim 1, further comprising a lower cushion positioned in the cavity between the core frame and the second cover.

4. The pillow apparatus of claim 1, wherein the core cushion comprises a thickness that is greater than a thickness of the peripheral cushion.

5. The pillow apparatus of claim 1, wherein the core cushion comprise a material that is different from a material of the peripheral cushion.

6. The pillow apparatus of claim 1, wherein the core cushion is retained by the core frame in a pocket formed by the core frame.

7. The pillow apparatus of claim 1, wherein the core cushion comprises at least one of a memory foam material, a latex material, a gel material, a fibrous material, or a porous material.

8. A cushion apparatus comprising:

a first cover including a first perimeter;

a second cover including a second perimeter, wherein at least a portion of the first perimeter is coupled to at least a portion of the second perimeter forming a cavity between the first cover and the second cover; and a core frame positioned within the cavity, wherein the core frame is planar, and wherein the core frame includes:

a core cushion retained in a center portion of the core frame; and a peripheral cushion retained within the core frame and surrounding and abutting an entire later perimeter of the core cushion, wherein the core cushion has a density that is greater than a density of the peripheral cushion, wherein a core frame perimeter of the core frame is coupled to at least one of the first cover or the second cover at one or more locations where the at least a portion of the first perimeter is coupled to the at least a portion of the second perimeter.

9. The cushion apparatus of claim 8, further comprising an upper cushion positioned in the cavity between the core frame and the first cover.

10. The cushion apparatus of claim 8, further comprising a lower cushion positioned in the cavity between the core frame and the second cover.

11. The cushion apparatus of claim 8, wherein the core cushion comprises a thickness that is greater than a thickness of the peripheral cushion.

12. The cushion apparatus of claim 8, wherein the core cushion comprises a material that is different from a material of the peripheral cushion.

13. The cushion apparatus of claim 8, wherein the core cushion is retained by the core frame in a pocket formed by the core frame.

14. The cushion apparatus of claim 8, wherein the core cushion comprises at least one of a memory foam material, a latex material, a gel material, a fibrous material, or a porous material.

15. A cushion apparatus comprising:

a first cover including a first perimeter;

a second cover including a second perimeter, wherein at least a portion of the first perimeter is coupled to at least a portion of the second perimeter forming a cavity between the first cover and the second cover; and a core frame positioned within the cavity, wherein the core frame is planar, and wherein the core frame includes:

a core cushion retained in a center portion of the core frame; and a peripheral cushion retained within the core frame and surrounding and abutting an entire lateral perimeter of the core cushion, wherein the core cushion comprises a thickness that is greater than a thickness of the peripheral cushion, wherein a core frame perimeter of the core frame is coupled to at least one of the first cover or the second cover at one or more locations where the at least a portion of the first perimeter is coupled to the at least a portion of the second perimeter.

16. The cushion apparatus of claim 15, further comprising an upper cushion positioned in the cavity between the core frame and the first cover.

17. The cushion apparatus of claim 15, further comprising a lower cushion positioned in the cavity between the core frame and the second cover.

18. The cushion apparatus of claim 15, wherein the core cushion is retained by the core frame in a pocket formed by the core frame.

19. The cushion apparatus of claim 15, wherein the core cushion comprises at least one of a memory foam material, a latex material, a gel material, a fibrous material, or a porous material.

20. The cushion apparatus of claim 15, wherein at least one of the first cover, the second cover, or the core frame comprises a fabric material.

* * * * *